US007318410B2

(12) United States Patent
Yokoi

(10) Patent No.: US 7,318,410 B2
(45) Date of Patent: Jan. 15, 2008

(54) STRADDLE TYPE VEHICLE HAVING AN ELECTRONIC THROTTLE VALVE SYSTEM

(75) Inventor: Masato Yokoi, Shizuoka (JP)

(73) Assignee: Yamaha Hatsudoki Kabushiki Kaisha, Shizuoka-Ken (JP)

( * ) Notice: Subject to any disclaimer, the term of this patent is extended or adjusted under 35 U.S.C. 154(b) by 0 days.

(21) Appl. No.: 11/408,600

(22) Filed: Apr. 20, 2006

(65) Prior Publication Data

US 2006/0243247 A1 Nov. 2, 2006

(30) Foreign Application Priority Data

May 2, 2005 (JP) ..... 2005-133782
Apr. 6, 2006 (JP) ..... 2006-105061

(51) Int. Cl.
*F02D 9/02* (2006.01)
*F02D 45/00* (2006.01)

(52) U.S. Cl. ..... 123/399; 123/400; 180/219

(58) Field of Classification Search ..... 123/361, 123/396, 399, 400; 180/219
See application file for complete search history.

(56) References Cited

U.S. PATENT DOCUMENTS 5,297,521 A * 3/1994 Sasaki et al. ..... 123/396
5,447,133 A * 9/1995 Kamio et al. ..... 123/396
5,778,853 A * 7/1998 Saito ..... 123/396
7,163,000 B2 * 1/2007 Ishida et al. ..... 123/399
2005/0211220 A1 * 9/2005 Matsuda ..... 123/399

FOREIGN PATENT DOCUMENTS

JP 2002-106368 4/2002

* cited by examiner

*Primary Examiner*—T. M Argenbright
(74) *Attorney, Agent, or Firm*—Hogan & Hartson LLP

(57) ABSTRACT

An electronic throttle valve system more suitable for use in straddle type vehicles. A straddle type vehicle has an electronic throttle valve system for adjusting the amount of intake air to an internal combustion engine. The electronic throttle valve system includes a throttle valve, an electric motor and a control unit. A guard mechanism is provided on a valve shaft of the throttle valve. The guard mechanism includes a pulley with which the throttle cable is engaged and a lever pulley which rotates in conjunction with the opening of the pulley. A cushion spring is provided on an edge face of a notched portion of the lever pulley, the edge face generally coming into contact with a protrusion that extends from the valve shaft of the throttle valve.

9 Claims, 6 Drawing Sheets

STRADDLE TYPE VEHICLE HAVING AN ELECTRONIC THROTTLE VALVE SYSTEM

BACKGROUND OF THE INVENTION

1. Field of the Invention

The present invention relates to a straddle type vehicle (e.g. two-wheeled motor vehicle), and particularly to a straddle type vehicle having an electronic throttle valve system for adjusting the amount of intake air to an internal combustion engine of the vehicle.

2. Description of Related Art

An electronic throttle valve system for electronically controlling the opening of a throttle valve to adjust the amount of intake air to an engine (internal combustion engine) can advantageously reduce emission and fuel consumption. This system has been used in some four-wheeled motor vehicles. Application of the system to two-wheeled motor vehicles has been under discussion (See JP-A-2002-106368, for example).

However, in contrast to four-wheeled motor vehicles, there are housing space limitations in the case of two-wheeled motor vehicles.

As compared to a four-wheeled motor vehicle having relatively less restrictions, the type of layout by which a mechanism is to be mounted in a two-wheeled motor vehicle cannot be determined simply, but is subject to severe restrictions.

SUMMARY OF THE INVENTION

The present invention is derived from the foregoing problem, and a principal object of the invention is to provide an electronic throttle valve system more suitable for use in a straddle type vehicle, and a straddle type vehicle having the electronic throttle valve system.

The present invention provides a straddle type vehicle having an electronic throttle valve system for adjusting the amount of intake air to an internal combustion engine. The electronic throttle valve system includes a throttle valve for adjusting the amount of intake air to the internal combustion engine, an electric motor for actuating the throttle valve, and a control unit for controlling the electric motor. The throttle valve is fixed to a valve shaft. The electric motor is connected to the valve shaft and is located for actuating the throttle valve through the valve shaft. A throttle opening sensor is provided on the valve shaft. The throttle opening sensor is in electrical connection with the control unit and detecting the opening of the throttle valve. A guard mechanism is provided on the valve shaft. The guard mechanism includes a pulley with which a throttle cable is engaged. The throttle cable is coupled to a throttle grip of the straddle type vehicle. A first rotational member operates in conjunction with the pulley. A second rotational member is formed on the valve shaft. The second rotational member operates in conjunction with the valve shaft. A relative movement of the first and the second rotational members is limited within a predetermined displacement. An elastic member is formed between the first and the second rotational members.

According to one preferred embodiment of the invention, the first rotational member is a lever pulley for operating in conjunction with the pulley. A notched portion is formed in the lever pulley. The notched portion is capable of contacting a protrusion that extends from the valve shaft of the throttle valve. The protrusion is the second rotational member. The notched portion has an opening generally shaped into a sector having an angle enough to accommodate the width of the protrusion. The lever pulley has a configuration such that, as the lever pulley rotates, an edge face of the notched portion with its generally sector-shaped opening generally comes into contact with the protrusion; and the elastic member is provided on the edge face generally coming into contact with the protrusion.

According to one preferred embodiment of the invention, the elastic member is located so as to generally come into contact with the protrusion when the throttle valve is actuated in such a direction that the throttle valve is closed.

According to one preferred embodiment of the invention, the elastic member is a cushion spring.

According to one preferred embodiment of the invention, the guard mechanism has a structure for actuating the throttle valve in conjunction with the operation of the throttle grip, in the event that the electric motor stops.

According to one preferred embodiment of the invention, the guard mechanism is provided with an accelerator-opening sensor for detecting the displacement of the acceleration controller. The accelerator-opening sensor is in electrical connection with the control unit. The control unit controls the electrical motor based on the displacement of the acceleration controller detected by the accelerator-opening sensor.

According to one preferred embodiment of the invention, the pulley and the lever pulley are coupled coaxially.

According to one preferred embodiment of the invention, the pulley and the lever pulley are coupled through a link member capable of varying a lever ratio.

Preferably, the straddle type vehicle is a two-wheeled motor vehicle with the electronic throttle valve system and the guard mechanism both installed inside a body frame.

According to the invention, in a straddle type vehicle having the electronic throttle valve system, a first rotational member (e.g. lever pulley) for operating in conjunction with the pulley of the guard mechanism, and a second rotational member (e.g. protrusion) for operating in conjunction with the valve shaft, are formed. Also, the elastic member (e.g. cushion spring) is formed between the first and the second rotational members. The elastic member, thus interposed, creates an appropriate gap between the first and the second rotational members, thereby allowing the electric motor to actuate the throttle valve smoothly. This results in achievement of the electronic throttle valve system that is more suitable for use in straddle type vehicles.

DETAILED DESCRIPTION OF THE INVENTION

Prior to arriving at the invention, the inventor studied the type of electronic throttle valve system installed in a two-wheeled motor vehicle, and how to operate the electronic throttle valve smoothly.

With reference to the appended drawings, an embodiment of the present invention will be described below. However, the present invention is not limited to the following embodiment.

Figure 1:
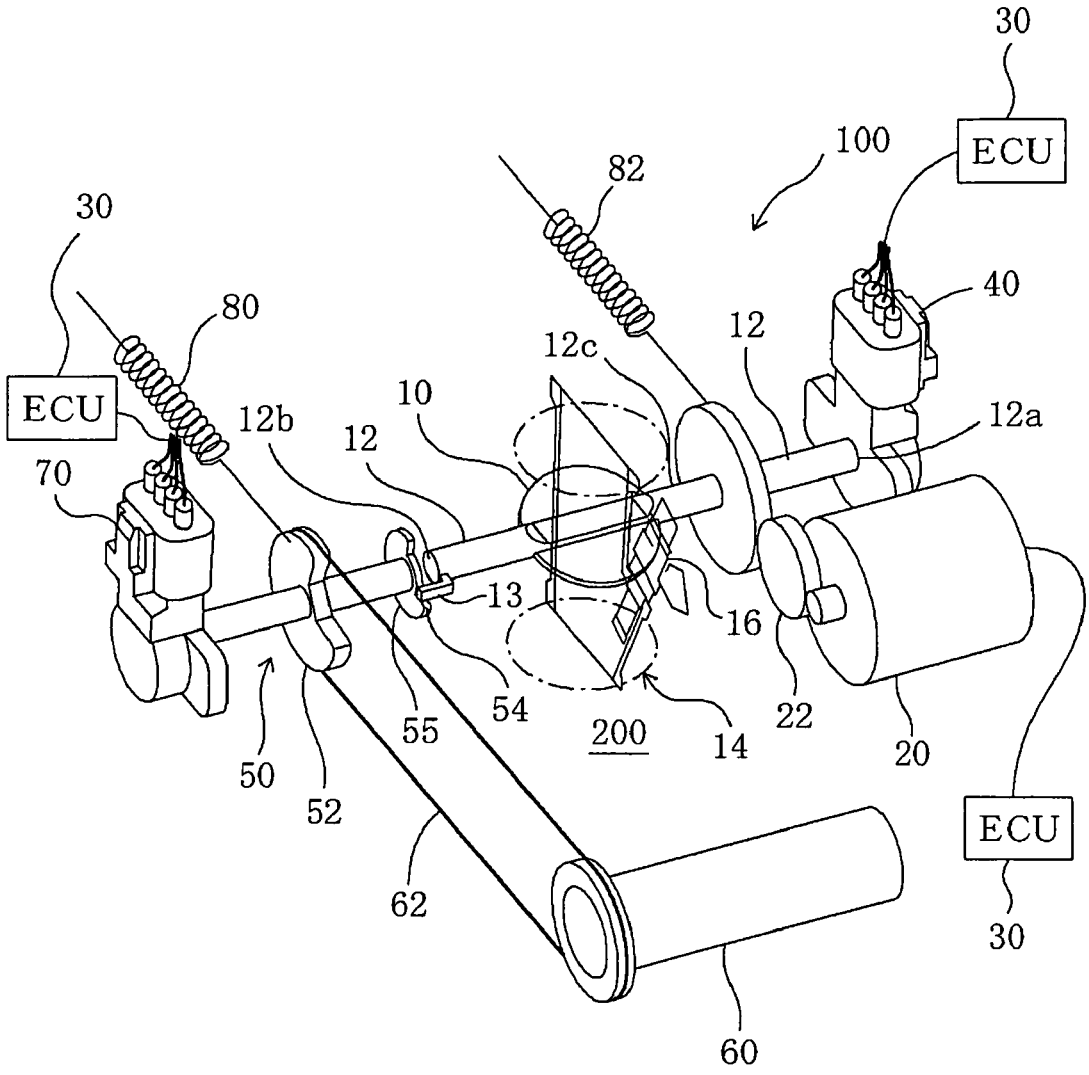
FIG. 1 is a perspective view, schematically showing a configuration of an electronic throttle valve system according to an embodiment of the present invention.

With reference to FIG. 1, an electronic throttle valve system according to an embodiment of the invention will be described. FIG. 1 is a perspective view schematically showing a configuration of the electronic throttle valve system 100 according to this embodiment.

The electronic throttle valve system 100 is mounted on a straddle type vehicle (e.g. two-wheeled motor vehicle) to adjust the amount of intake air to an internal combustion engine 200 of the vehicle. The electronic throttle valve system 100 includes a throttle valve 10 for adjusting the amount of intake air to the internal combustion engine 200, an electric motor 20 for driving the throttle valve 10, and a control unit (ECU: electronic control unit) 30 for controlling the electric motor 20.

The throttle valve 10 is fixed to a valve shaft 12. The throttle valve 10 of this embodiment, which is a butterfly throttle valve, is disposed within a throttle body 14. The throttle body 14 is provided with a fuel injector 16 for injecting fuel. FIG. 1 solely illustrates one throttle valve 10 for easier understanding, although plural throttle valves 10 are typically provided within the throttle body 14.

The electric motor 20 is connected to the valve shaft 12 of the throttle valve 10 so that the electric motor 20 can actuate the throttle valve 10 through the valve shaft 12. In this embodiment, the electric motor 20 is connected to a midsection 12*c* between a right end 12*a* and a left end 12*b* of the valve shaft 12. FIG. 1 illustrates the electric motor 20 connected to the valve shaft 12 through a drive gear 22. The electric motor 20 is in electrical connection with the ECU 30.

The valve shaft 12 is provided with a throttle opening sensor 40 for detecting the opening of the throttle valve 10. In this embodiment, the throttle opening sensor 40 is located on the right end 12*a* of the valve shaft 12. The throttle opening sensor 40 is in electrical connection with the ECU 30.

The valve shaft 12 is also provided with a guard mechanism (it may also be referred to as "mechanical, throttle valve actuating mechanism") 50. In this embodiment, the guard mechanism 50 is located on the left end 12*b* of the valve shaft 12. The guard mechanism 50 is designed to actuate the throttle valve 10 in conjunction with the operation of a throttle grip 60 in the event that the electric motor 20 stops actuating the throttle valve 10. The throttle grip 60 is provided on one of a pair of handlebars (not shown) of the straddle type vehicle. A throttle cable 62 connected to the throttle grip 60 is engaged with the guard mechanism 50. The throttle grip 60 is an acceleration controller. A lever, which has a similar function to the throttle grip, may also be employed as the acceleration controller. The form of acceleration controller is not limited to the throttle grip.

In this embodiment, the guard mechanism 50 includes a pulley 52 with which the throttle cable 62, connected to the throttle grip 60, is engaged and a lever pulley 54 which rotates in conjunction with the opening of the pulley 52. The lever pulley 54 includes a notched portion 55 which can come into contact with a protrusion 13 extending from the valve shaft 12 of the throttle valve 10. The notched portion 55 and the protrusion 13 correspond to a combination of a first and a second rotational member. In the combination, the notched portion 55 can be one of the rotational members, while the protrusion 13 can be the other, and vice versa. A relative movement of these first and second rotational members is limited within a predetermined displacement due to their structures. The combination of the first and the second rotational members may not be limited to the combination of the notched portion 55 and the protrusion 13, but may employ other components to serve the same function. As described above, an elastic member is formed between the first and second rotational members.

FIG. 1 illustrates the notched portion 55 with its opening generally shaped into a sector having an angle enough to accommodate the width of the protrusion 13. As the lever pulley 54 rotates, the edge face of the notched portion 55 with its generally sector-shaped opening can come into contact with the protrusion 13. Further, the elastic member (e.g. cushion spring), which is not shown, is provided on the edge face of the notched portion 55 that generally comes into contact with the protrusion 13. The elastic member is not limited to the spring. A sponge or rubber member may also be used.

The guard mechanism 50 is provided with an accelerator-opening sensor 70 for detecting the displacement of the acceleration controller (i.e. opening of the accelerator). The accelerator-opening sensor 70 is in electrical connection with the ECU 30. The ECU 30 controls the electrical motor 20 based on the opening of the accelerator detected by the accelerator-opening sensor 70.

FIG. 1 illustrates three ECUs 30 for convenience of description, but indeed, there exists only one ECU. In other words, the typical electronic throttle valve system 100 is provided with one ECU 30. It should be noted that plural ECUs 30 may be connected to one another. In this embodiment, return springs 80, 82 are separately provided.

In the illustrative configuration shown in FIG. 1, the pulley 52 and the lever pulley 54 are coaxially coupled. However, the invention is not limited to this configuration. Both pulleys may be coupled, such that the lever pulley 54 can rotate in conjunction with the opening of the pulley 52, using a link member, for example.

Figure 2:
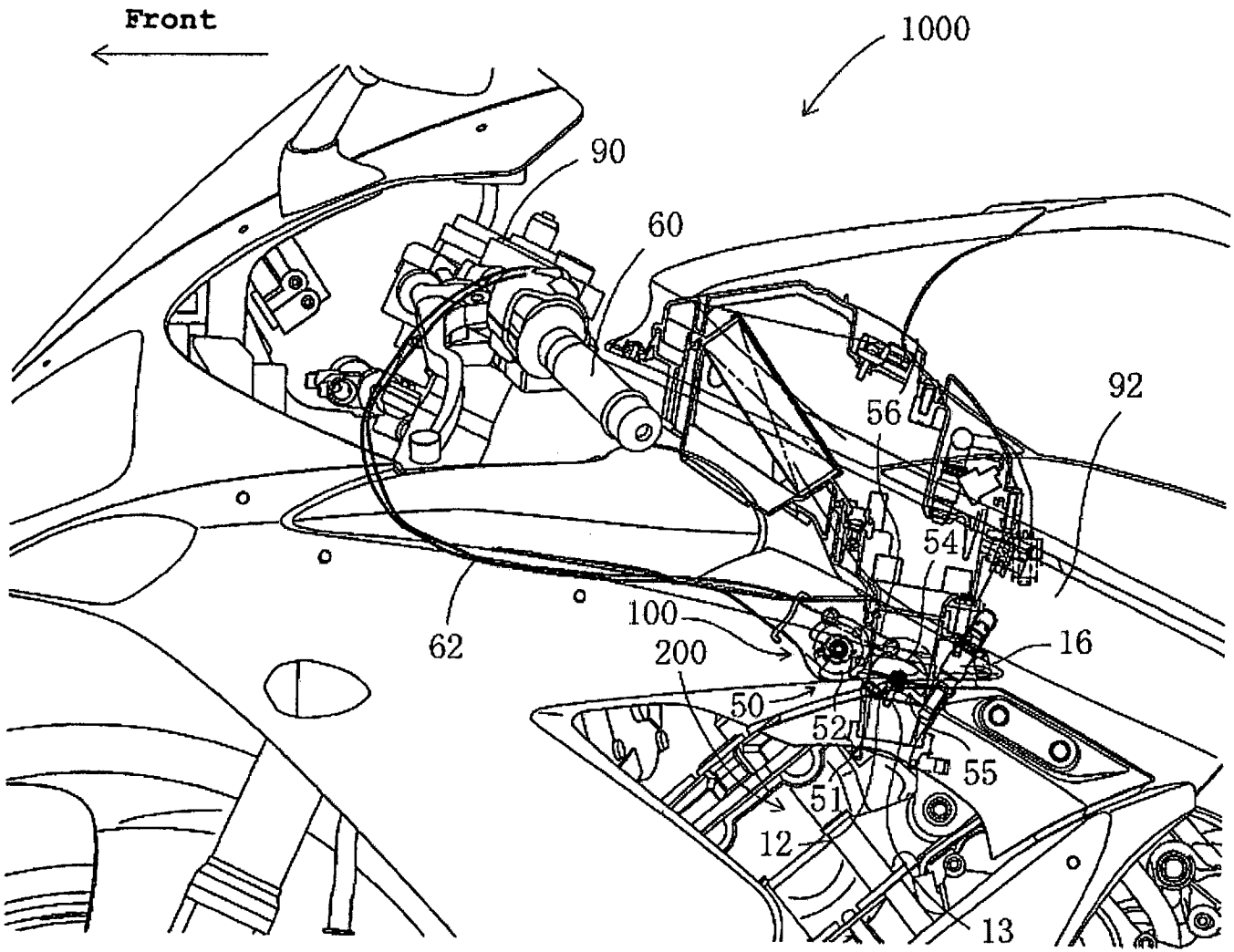
FIG. 2 is a perspective side view, showing a configuration in which the electronic throttle valve system according to an embodiment of the present invention is mounted to a two-wheeled motor vehicle.
Figure 3:
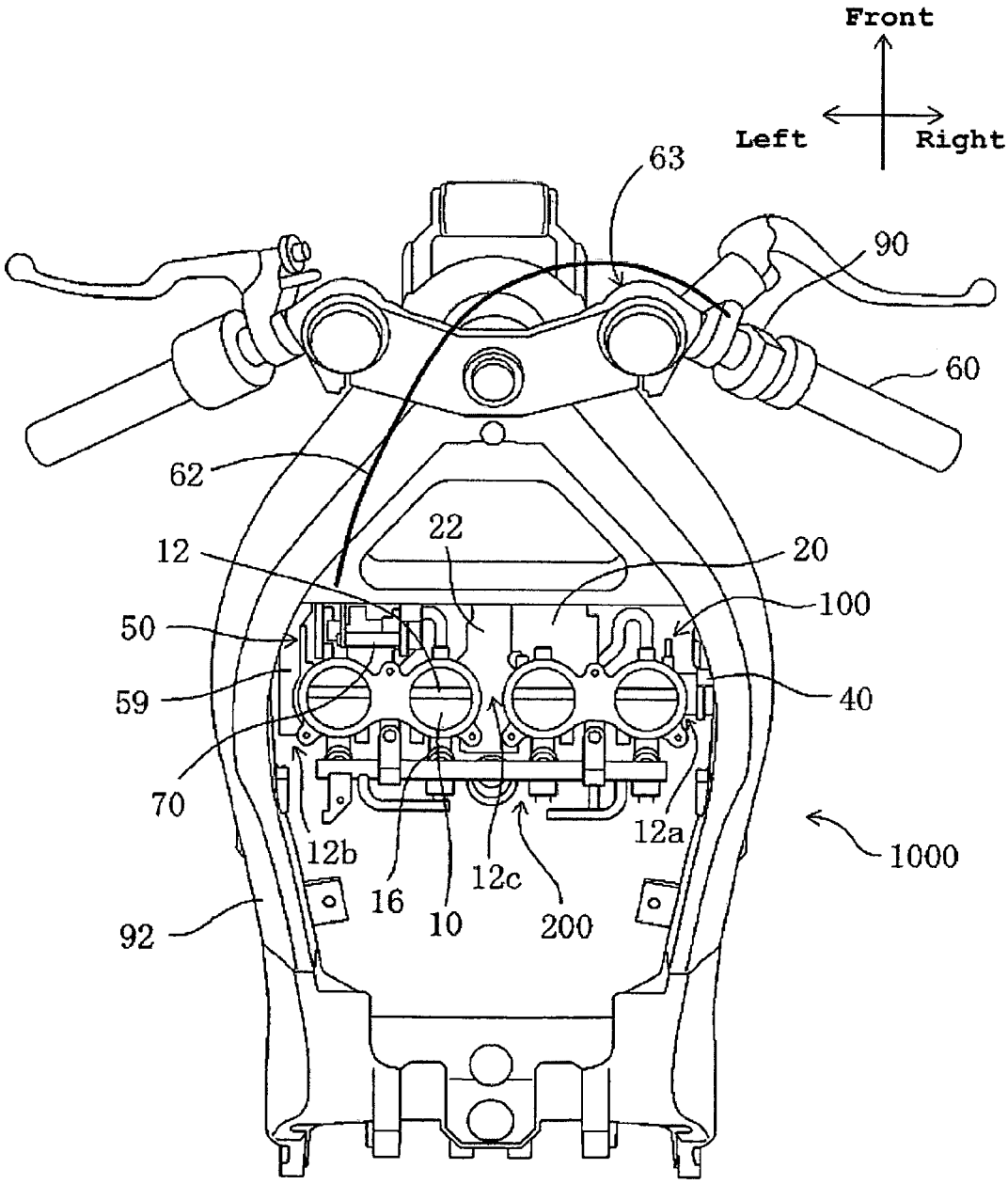
FIG. 3 is a perspective top view of the two-wheeled motor vehicle according to an embodiment of the present invention.

FIGS. 2 and 3 are perspective side and top views respectively, showing a configuration in which the electronic throttle valve system 100 of this embodiment is mounted on a two-wheeled motor vehicle 1000. As shown in FIG. 2, the throttle grip 60 lies on a left one of the pair of the handlebars.

As shown in FIG. 2, the throttle cable 62 extending from the throttle grip 60 engages with the pulley 52. FIG. 2 illustrates the pulley 52 and the lever pulley 54 coupled through a link member 56 capable of varying a lever ratio.

As illustrated in FIG. 3, in the two-wheeled motor vehicle 1000 of this embodiment, the throttle cable 62 extends from the throttle grip 60, which is provided on a right one of a pair of handlebars 90 of the two-wheeled motor vehicle, to connect to the guard mechanism 50. The pulley 52 and the lever pulley 54 are housed within a cover 59 of the guard mechanism 50.

As shown in FIG. 3, the electronic throttle valve system 100 and the guard mechanism 50 of this embodiment can both be installed inside a body frame 92. In this manner, the system 100 and the mechanism 50 are both adapted to suit use in a two-wheeled motor vehicle that has a limited layout space. Due to the limited layout space, the valve shaft 12 is preferably placed so as to extend in the lateral direction of the two-wheeled motor vehicle 1000, so that the accelerator-opening sensor 70 and the electric motor 20 can both be located either forward or rearward of the valve shaft 12. In the illustrative configuration, the accelerator-opening sensor 70 and the electric motor 20 are both located forward of the valve shaft 12.

Figure 4:
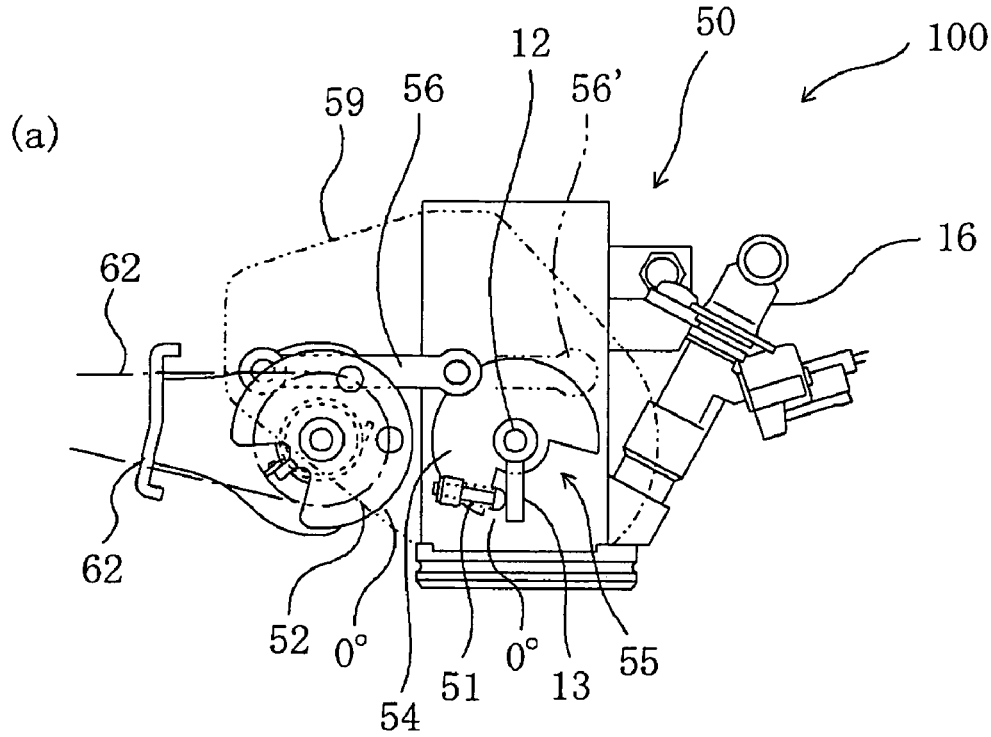
FIGS. 4(*a*) and 4(*b*) are side views, illustrating the operation of the electronic throttle valve system according to an embodiment of the present invention.
Figure 4:
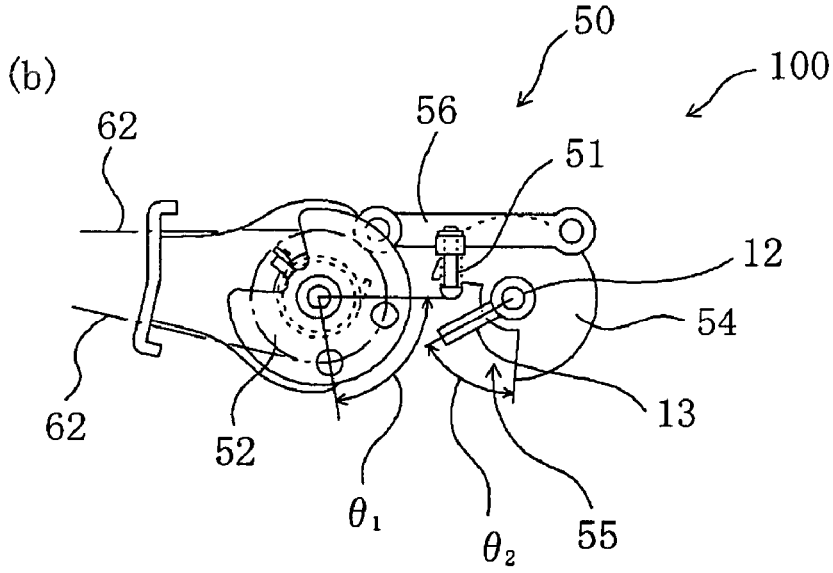
Figure 5:
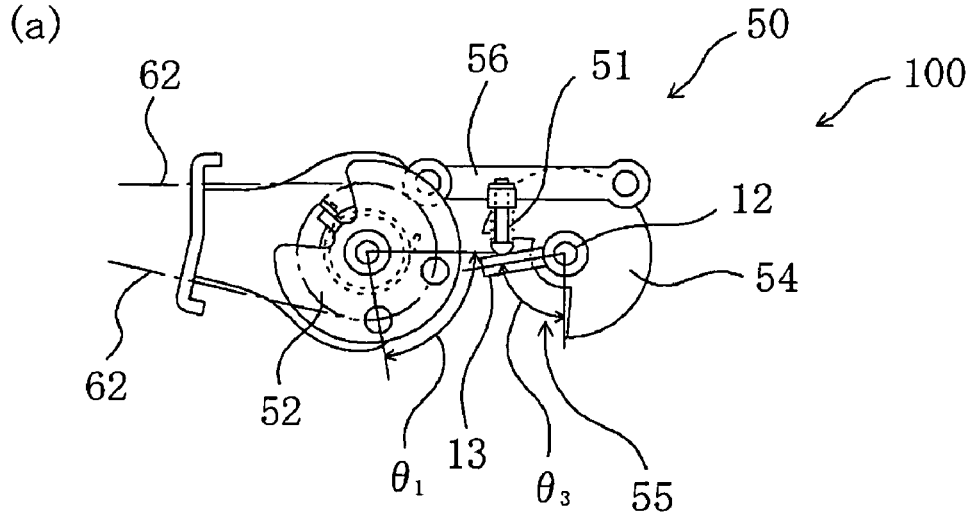
FIGS. 5(*a*) and 5(*b*) are side views, illustrating the operation of the electronic throttle valve system according to an embodiment of the present invention.
Figure 5:
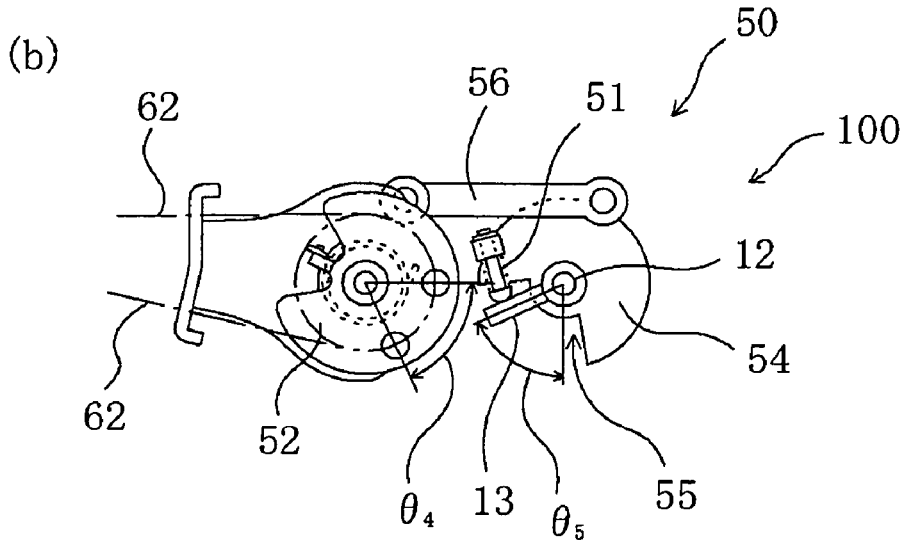
Figure 6:
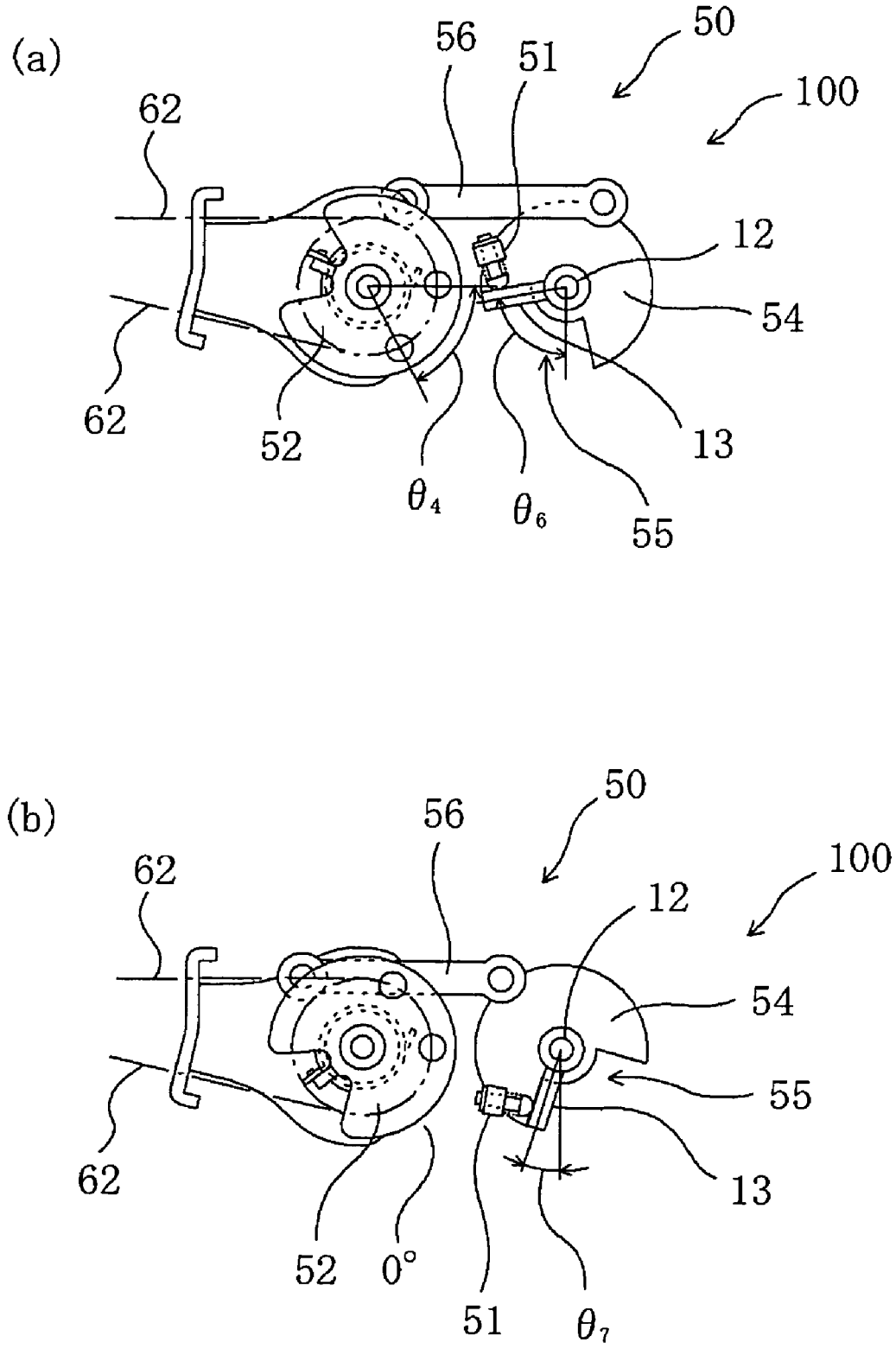
FIGS. 6(*a*) and 6(*b*) are side views, illustrating the operation of the electronic throttle valve system according to an embodiment of the present invention.

Next, with reference to FIGS. 4 through 6, the operation of the guard mechanism 50 of this embodiment will be described. FIGS. 4 through 6 are side perspective views of the guard mechanism 50 of FIG. 2.

FIG. 4(*a*) illustrates the throttle valve fully closed, in which peripheral members, such as the injector 16 and the cover 59, are also shown for reference purpose. FIG. 4(*b*) shows the throttle valve sharply opened, following the condition of FIG. 4(*a*). FIG. 5(*a*) shows the throttle valve fully opened, while FIG. 5(*b*) shows the throttle valve sharply closed, following the condition of FIG. 5(*a*). FIG. 6(*a*) shows the throttle valve further closed, following the condition of FIG. 5(*b*). FIG. 6(*b*) shows the throttle valve which is fully opened through manual operation in the emergency situations.

Under the condition shown in FIG. 4(*a*), the pulley 52 has the opening of 0° while the protrusion (claw) 13 has the opening of 0°, the opening of the protrusion being affected by the opening of the throttle valve 10 (opening of the butterfly valve). The link member 56 can move to a point 56' indicated by the dotted line in FIG. 4(*a*), if the throttle valve is fully opened.

When the protrusion 13 has the opening of 0°, a distal end of the cushion spring 51, which protrudes from the edge face of the notched portion 55 of the lever pulley 54, generally comes into contact with the protrusion 13. In this embodiment, however, there is an angular gap of $\theta_0$ (e.g. about 2°) between the distal end of the cushion spring 51 and the protrusion 13. The cushion spring 51 is located on the side where the cushion spring 51 generally comes into contact with the protrusion 13 when the throttle valve is actuated in such a direction that the throttle valve is closed.

When the throttle valve is sharply opened as shown in FIG. 4(*b*) following the condition of FIG. 4(*a*), the accelerator-opening sensor 70 of FIG. 1 detects the opening of the accelerator and sends data thereof to the control unit (ECU) 30. Based on the data, the ECU controls the electric motor 20 to actuate the throttle valve 10.

With reference to the side view shown in FIG. 4(*b*), as the pulley 52 rotates, the pulley 52 has the opening of $\theta_1$ (e.g. 80°) while the throttle valve 10 has the opening (i.e. opening of the protrusion 13) of $\theta_2$ (e.g. 60°). The link member 56 is designed to establish the relationship: $\theta_1 > \theta_2$. As the pulley 52 rotates, the lever pulley 54 also rotates through the link member 56. This allows the edge face and the cushion spring 51 on the notched portion 55 of the lever pulley 54 to move.

As shown in FIG. 4(*b*), the opening of the cushion spring 51 of the lever pulley 54, which operates in conjunction with the pulley 52 through the link member 56, is greater than the opening $\theta_2$ of the protrusion 13. This results in a greater gap between the protrusion 13 and the cushion spring 51, thus causing a difference between the target opening and the resultant opening.

Since the target opening is greater than the resultant opening, in other words, the distal end of the cushion spring 51 moves ahead the protrusion 13, this tends to facilitate application of full power (full duty) to the electric motor (See FIG. 1) 20. This results in more responsive operation of the guard mechanism 50.

After that (e.g. less than 0.1 second later), as shown in FIG. 5(*a*), when the protrusion 13 catches up with the distal end of the cushion spring 51, in other words, when the resultant opening becomes equal to the target opening, then the throttle valve is fully opened. The opening $\theta_3$ of the protrusion 13 becomes equal to the opening $\theta_1$ of the pulley, that is, e.g. 80°.

Next, as shown in FIG. 5(*b*), when the throttle valve is sharply closed, the pulley 52 rotates and accordingly, the distal end of the cushion spring 51 of the lever pulley 54 catches up with the protrusion 13. There is a slight difference (e.g. 2°) between the target opening $\theta_4$ (e.g. 63°) and the resultant opening $\theta_5$ (e.g. 65°). The opening $\theta_4$ is smaller than the opening $\theta_1$, while the opening $\theta_5$ is smaller than the opening $\theta_3$.

After that, as shown in FIG. 6(*a*), the cushion spring 51 is compressed, which increases the difference (e.g. 17°) between the target opening $\theta_4$ (e.g. 63°) and the resultant opening $\theta_6$ (e.g. 80°). Thus, the electric motor (See FIG. 1) 20 can be easily applied with full duty, resulting in more responsive operation of the guard mechanism.

Lastly, operation of the guard mechanism 50 in the emergency situations will be described. In the event that the electric motor 20 stops driving the throttle valve due to the interruption of the current from the motor 20, the guard mechanism 50 can serve the same function. In other words, the throttle valve 10 is manually opened or closed.

When the throttle valve is fully closed through manual operation, following the condition of FIG. 6(*a*), the compressed cushion spring 51 and the edge face of the notched portion 55 pushes the protrusion 13, which decreases the opening $\theta_7$ (e.g. 17°) thereof as shown in FIG. 6(*b*). This allows for full closing or compulsory return of the throttle valve through manual operation even in emergency situations. Also, the throttle opening of $\theta_7$ allows the two-wheeled motor vehicle 1000 to run at reduced speed. It should be noted that the throttle valve may be fully closed again as shown in FIG. 4(*a*), following the condition of FIG. 6(*b*).

As described above, in the electronic throttle valve system 100 according to the present invention, the notched portion 55 is formed in the lever pulley 54 of the guard mechanism 50, and the cushion spring 51 is provided on the edge face of the notched portion 55. The cushion spring 51 thus interposed creates an appropriate gap between the edge face of the notched portion 55 and the protrusion 13. Thus, the electric motor 20 can be easily applied with full duty, thereby actuating the throttle valve 10 smoothly. This results in establishment of an electronic throttle valve system that is more suitable for use in straddle type vehicles. The cushion spring 51 also serves as a cushion with a function to protect the edge face of the notched portion 55 and the protrusion 13.

The effect of the invention that the cushion spring 51 helps actuate the throttle valve 10 smoothly can be obtained not only in the embodiment in which the pulley 52 and the lever pulley 54 are coupled through the link member 56, but also in the other embodiment of FIG. 1 in which both the pulleys are coupled coaxially. Similar to that, the cushioning effect provided by the cushion spring 51 can also be obtained in this embodiment in which both the pulleys are coupled coaxially.

The two-wheeled motor vehicle 1000 shown in FIGS. 2 and 3 is an on-road vehicle. However, the invention is not limited to that, but may also be applied to any off-road two-wheelers. The term "two-wheeled motor vehicle" used herein means a motorcycle, including every motorbike and motor scooter, and, more particularly, is a vehicle which can be turned by tilting the vehicle body. Thus, a vehicle equipped with two or more front wheels and/or two or more rear wheels, thus having three or four (or more) wheels in total is also included in the "two-wheeled motor vehicle."

Without any limitation to two-wheeled motor vehicles, the invention may also be applied to other vehicles, as long as a vehicle can take advantage of effects of the invention. The other vehicles include so-called straddle type vehicles, such as four-wheeled buggies or all terrain vehicles (ATV) and snowmobiles.

While the invention is explained above by way of preferable embodiments, such descriptions are not limiting items. Therefore, various modifications may be made. For example, in the above embodiment, the accelerator-opening sensor 70 is mounted on the guard mechanism 50, but the invention is not limited to that. In other words, as long as the opening of the accelerator would be detected, the accelerator-opening sensor 70 may use the opening of the throttle grip, for example, and accordingly the layout of the sensor 70 may be changed for convenience.

The present invention provides the excellent advantages as described above. However, the practical application of the invention to straddle type vehicles should involve consideration of the embodiments from an overall viewpoint including other requirements.

The present invention provides an electronic throttle valve system more suitable for use in straddle type vehicles.

The invention claimed is:

1. A straddle type vehicle having an electronic throttle valve system for adjusting the amount of intake air to an internal combustion engine, the electronic throttle valve system comprising:

a throttle valve for adjusting the amount of intake air to the internal combustion engine;

an electric motor for actuating the throttle valve; and a control unit for controlling the electric motor, wherein the throttle valve is fixed to a valve shaft;

the electric motor, connected to the valve shaft, is located for actuating the throttle valve through the valve shaft;

a throttle opening sensor is provided on the valve shaft, the throttle opening sensor being in electrical connection with the control unit and detecting the opening of the throttle valve;

a guard mechanism is provided on the valve shaft, the guard mechanism including: a pulley with which a throttle cable is engaged, the throttle cable being coupled to a throttle grip of the straddle type vehicle; and a first rotational member for operating in conjunction with the pulley;

a second rotational member is formed on the valve shaft, the second rotational member operating in conjunction with the valve shaft;

a relative movement of the first and the second rotational members is limited within a predetermined displacement; and an elastic member is formed between the first and second rotational members and is movable with the first rotational member, wherein the elastic member moves ahead of the second rotational member in an opening direction of the throttle valve, and the elastic member moves with the second rotational member in a closing direction of the throttle valve.

2. A straddle type vehicle having an electronic throttle valve system for adjusting the amount of intake air to an internal combustion engine, the electronic throttle valve system comprising:

a throttle valve for adjusting the amount of intake air to the internal combustion engine;

an electric motor for actuating the throttle valve; and a control unit for controlling the electric motor, wherein the throttle valve is fixed to a valve shaft;

the electric motor, connected to the valve shaft, is located for actuating the throttle valve through the valve shaft;

a throttle opening sensor is provided on the valve shaft, the throttle opening sensor being in electrical connection with the control unit and detecting the opening of the throttle valve;

a guard mechanism is provided on the valve shaft, the guard mechanism including: a pulley with which a throttle cable is engaged, the throttle cable being coupled to a throttle grip of the straddle type vehicle; and a first rotational member for operating in conjunction with the pulley;

a second rotational member is formed on the valve shaft, the second rotational member operating in conjunction with the valve shaft;

a relative movement of the first and the second rotational members is limited within a predetermined displacement; and an elastic member is formed between the first and second rotational members, wherein the first rotational member is a lever pulley for operating in conjunction with the pulley; a notched portion is formed in the lever pulley, the notched portion being capable of contacting a protrusion that extends from the valve shaft of the throttle valve; the protrusion is the second rotational member; the notched portion opens in a substantially fan shape having an angle wider than an angle corresponding to the width of the protrusion; the lever pulley has a configuration such that as the lever pulley rotates, an edge face of the notched portion, which opens in the substantially fan shape, generally comes into contact with the protrusion; and the elastic member is provided on the edge face generally coming into contact with the protrusion.

3. The straddle type vehicle according to claim 2, wherein the elastic member is located so as to generally come into contact with the protrusion when the throttle valve is actuated in such a direction that the throttle valve is closed.

4. The straddle type vehicle according to claim 3, wherein the elastic member is a cushion spring.

5. The straddle type vehicle according to claim 4, wherein the guard mechanism has a mechanism that can actuate the throttle valve in conjunction with the operation of the throttle grip, in the event that the electric motor stops.

6. The straddle type vehicle according to claim 4, wherein the guard mechanism is provided with an accelerator-opening sensor that detects the displacement of the acceleration controller; the accelerator-opening sensor is in electrical connection with the control unit; and the control unit controls the electrical motor based on the opening of the acceleration controller detected by the accelerator-opening sensor.

7. The straddle type vehicle according to claim 4, wherein the pulley and the lever pulley are coupled coaxially.

8. The straddle type vehicle according to claim 4, wherein the pulley and the lever pulley are coupled through a link member capable of varying a lever ratio.

9. The straddle type vehicle according to claim 8, wherein the straddle type vehicle is a two-wheeled motor vehicle with the electronic throttle valve system and the guard mechanism both installed inside a body frame.

* * * * *